US010587074B2

(12) United States Patent
Esmaeili et al.

(10) Patent No.: US 10,587,074 B2
(45) Date of Patent: Mar. 10, 2020

(54) HYBRID ELECTRICAL CONNECTOR

(71) Applicant: Apple Inc., Cupertino, CA (US)

(72) Inventors: Hani Esmaeili, Santa Clara, CA (US); Daniel T. McDonald, San Jose, CA (US); Aaron A. Oro, Menlo Park, CA (US); Eric S. Jol, San Jose, CA (US)

(73) Assignee: Appple Inc., Cupertino, CA (US)

( * ) Notice: Subject to any disclaimer, the term of this patent is extended or adjusted under 35 U.S.C. 154(b) by 0 days.

(21) Appl. No.: 15/964,746

(22) Filed: Apr. 27, 2018

(65) Prior Publication Data

US 2019/0103700 A1 Apr. 4, 2019

Related U.S. Application Data

(60) Provisional application No. 62/565,420, filed on Sep. 29, 2017.

(51) Int. Cl.

| | |
|---|---|
| ***H01R 13/56*** | (2006.01) |
| ***H01R 12/59*** | (2011.01) |
| ***H01R 13/436*** | (2006.01) |
| ***H01R 13/506*** | (2006.01) |
| ***H01R 13/03*** | (2006.01) |
| ***H01R 13/6582*** | (2011.01) |
| ***H01R 13/24*** | (2006.01) |

(52) U.S. Cl.

CPC ..... *H01R 13/56* (2013.01); *H01R 12/592* (2013.01); *H01R 13/4367* (2013.01); *H01R 13/03* (2013.01); *H01R 13/2407* (2013.01); *H01R 13/506* (2013.01); *H01R 13/6582* (2013.01)

(58) Field of Classification Search

CPC .... H01R 12/61; H01R 13/56; H01R 13/6582; H01R 13/03

See application file for complete search history.

(56) References Cited

U.S. PATENT DOCUMENTS

| | | | | |
|---|---|---|---|---|
| 3,790,916 | A * | 2/1974 | Keitel | H05K 3/3405 439/435 |
| 4,448,474 | A * | 5/1984 | Melnychenko | H01R 12/75 439/472 |
| 4,740,867 | A * | 4/1988 | Roberts | H01R 12/79 361/749 |
| 5,295,843 | A | 3/1994 | Davis et al. | |
| 5,372,512 | A * | 12/1994 | Wilson | B41J 2/1752 439/493 |
| 5,679,018 | A * | 10/1997 | Lopata | H01R 12/716 439/260 |
| 6,256,879 | B1 * | 7/2001 | Neidich | H05K 3/4015 29/423 |
| 6,299,476 | B1 | 10/2001 | Schramme et al. | |
| 7,144,256 | B2 * | 12/2006 | Pabst | H01R 12/79 439/67 |

(Continued)

*Primary Examiner* — Briggitte R. Hammond
(74) *Attorney, Agent, or Firm* — Kilpatrick Townsend and Stockton, LLP

(57) ABSTRACT

An electronic receptacle connector includes a hybrid contact assembly that includes a contact plate that has multiple fingers, a contact positioned at a distal end of each finger and a conductor that runs along each finger and electrically couples each contact to an interconnect region positioned outside of the housing. The fingers are made from a first material and the contacts are made from a second material such that each of the first and the second materials can be independently optimized.

20 Claims, 9 Drawing Sheets

(56) References Cited

U.S. PATENT DOCUMENTS

| | | | | |
|---|---|---|---|---|
| 7,819,696 | B2 * | 10/2010 | Wu | H01R 12/592<br>439/607.01 |
| 2003/0029907 | A1 * | 2/2003 | Neidich | H01R 12/62<br>228/180.22 |
| 2007/0105447 | A1 * | 5/2007 | Tsai | H01R 12/62<br>439/630 |
| 2010/0203747 | A1 * | 8/2010 | Hu | H05K 1/118<br>439/77 |
| 2011/0269321 | A1 * | 11/2011 | Mizoguchi | H01R 12/613<br>439/77 |

* cited by examiner

HYBRID ELECTRICAL CONNECTOR

CROSS-REFERENCES TO OTHER APPLICATIONS

This application claims priority to U.S. Provisional Application No. 62/565,420, for "HYBRID ELECTRICAL CONNECTOR" filed on Sep. 29, 2017 which is hereby incorporated by reference in entirety for all purposes.

FIELD

The described embodiments relate generally to electronic connectors that can be used to communicate signals and/or power between electronic devices. More particularly, the present embodiments relate to receptacle connectors that employ a first material for resilient contact fingers and a second material for electrical contacts that are mounted to the fingers so that each material can be independently optimized for its particular function within the electrical connector.

BACKGROUND

Currently there are a wide variety of electronic devices that include one or more external electrical receptacle connectors configured to repetitively receive a corresponding mating connector and couple power and/or data to the electronic device. As the receptacle connector is repetitively coupled with the corresponding mating connector the contacts within the receptacle connector can degrade resulting in an increase in contact resistance and ultimately failure of the connector and the electronic device. As electronic devices become a more integral part of everyone's lives and are used more frequently, new electrical connectors may require new features to increase the reliability of the connectors so they can survive an increased number of mating cycles without failing.

SUMMARY

Some embodiments of the present disclosure relate to receptacle connectors for electronic devices where the receptacle connectors are employed to repetitively couple to a corresponding mating connector. Some embodiments include a receptacle connector having a housing that defines a cavity configured to receive the mating connector. A hybrid contact assembly is positioned within the cavity and includes a contact plate that has multiple fingers, electrical contacts positioned at a distal end of each finger and conductors that run along each finger and electrically couple each contact to an interconnect region positioned outside of the housing. The fingers are made from a first material that is different from a second material that the contacts are made from. In some embodiments, the use of different materials for the fingers and the contacts enables the finger material to be optimized for fatigue resistance, corrosion resistance and strength while the contact material can be independently optimized for low contact resistance, corrosion resistance and wear resistance. The hybrid contact assembly can result in improved reliability of the receptacle connector.

In some embodiments a receptacle connector comprises a housing defining a cavity and including a receiving opening for the cavity. The cavity and the receiving opening are shaped to allow a corresponding plug connector to be inserted through the receiving opening and into the cavity. A plurality of fingers are secured to the housing, each finger having a base portion and a distal end portion positioned within the cavity. A plurality of electrical conductors are attached to a respective one of the plurality of fingers, each electrical conductor extending from the distal end portion of a respective one of the plurality of fingers to an interconnect region positioned outside of the housing. A plurality of electrical contacts are attached to a respective one of the plurality of electrical conductors, each electrical contact positioned proximate the distal end portion of a respective one of the plurality of fingers.

In various embodiments each of the plurality of fingers comprises a first metal having a first modulus of elasticity and each of the plurality of electrical contacts comprises a second metal having a second modulus of elasticity, wherein the first modulus of elasticity is higher than the second modulus of elasticity. In some embodiments the plurality of electrical conductors are integrated within a flexible circuit. In various embodiments the interconnect region is formed from a portion of the flexible circuit.

In some embodiment the base portions of each of the plurality of fingers are coupled together forming a common base portion. In various embodiments the plurality of electrical contacts are electrically insulated from the plurality of fingers.

In some embodiments the cavity and the receiving opening are shaped to allow the corresponding plug connector to be inserted through the receiving opening and into the cavity in a first orientation and in a second orientation, wherein the second orientation is rotated 180 degrees from the first orientation.

In some embodiments a receptacle connector comprises a housing defining a cavity and including a receiving opening for the cavity wherein the cavity and the receiving opening shaped to allow a corresponding plug connector to be inserted through the receiving opening and into the cavity. A finger having a base portion is secured to the housing and a distal end portion is positioned within the cavity. An electrical conductor is attached to the finger and extends from the distal end portion to an interconnect region positioned outside of the housing. An electrical contact is attached to the electrical conductor and is positioned proximate the distal end portion of the finger.

In some embodiments the receptacle connector further comprises a plurality of fingers, each finger having a base portion. In various embodiments the base portion of each of the plurality of fingers is coupled together forming a common base portion. In some embodiments the receptacle connector further comprises a plurality of electrical conductors. In various embodiments the plurality of electrical conductors are integrated within a flexible circuit.

In some embodiments an insulator is positioned between the electrical conductor and the finger. In various embodiments the finger comprises a first metal and the electrical contact comprises a second metal, and wherein the first metal has a higher modulus of elasticity than the second metal.

In some embodiments the electrical contact is electrically insulated from the finger. In various embodiments the cavity and the receiving opening are shaped to allow the corresponding plug connector to be inserted through the receiving opening and into the cavity in a first orientation and in a second orientation, wherein the second orientation is rotated 180 degrees from the first orientation.

In some embodiments the receptacle connector further comprises a rear cover that is received within a rear opening of the housing. In various embodiments the rear cover includes at least one ground prong that extends into the cavity. In some embodiments the finger comprises stainless steel. In various embodiments the electrical contact comprises gold.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evident to the contrary from the description, where elements in different figures use identical reference numbers, the elements are generally either identical or at least similar in function or purpose.

DETAILED DESCRIPTION

Figure 1:
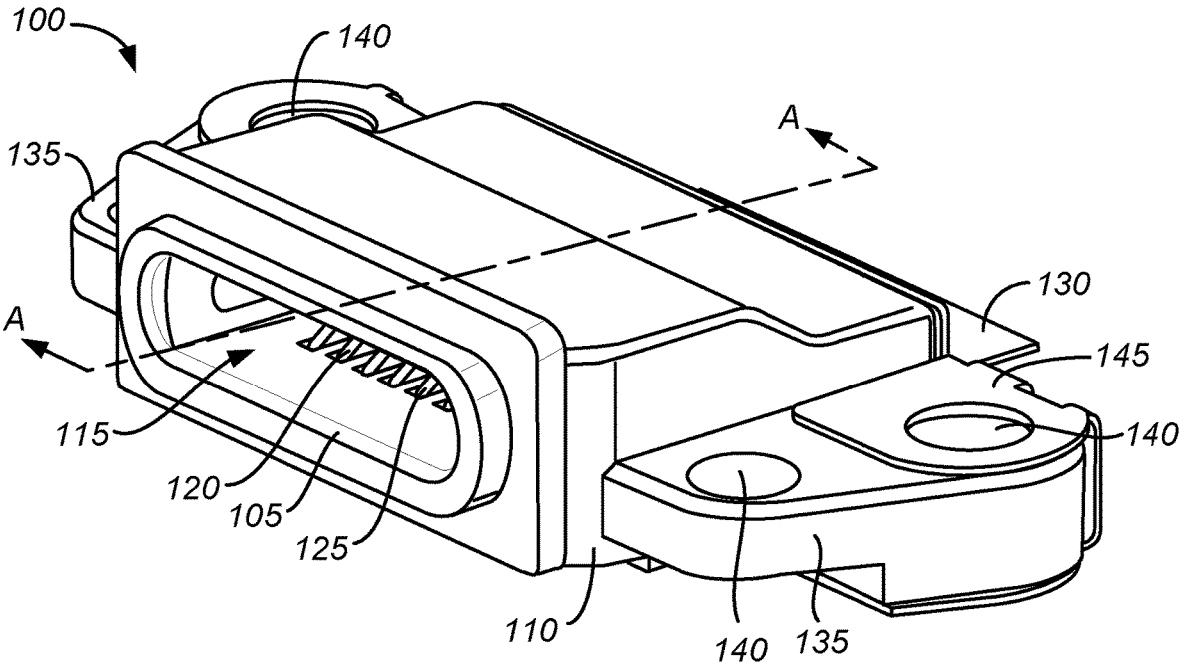
FIG. 1 is a front perspective view of a receptacle connector according to an embodiment of the disclosure.

Some embodiments of the present disclosure relate to electrical receptacle connectors having improved reliability as compared to traditional receptacle connectors. More specifically, in various embodiments a hybrid contact assembly is positioned within a receptacle connector housing and is arranged to make contact with a corresponding mating connector. The hybrid contact assembly is referred to as a hybrid because it employs metallic leads made from a first material, contacts made from a second material and circuitry that runs along the leads. More specifically, the hybrid contact assembly includes a contact plate that has multiple resilient fingers, electrical contacts positioned at a distal end of each finger and electrical conductors that run along each finger and electrically couple each contact to an interconnect region positioned outside of the connector housing. The fingers are made from a first material that is different from a second material that the contacts are made from, enabling each material to be independently optimized, as described in more detail below.

While the present disclosure can be useful for a wide variety of configurations, some embodiments of the disclosure are particularly useful for receptacle connectors that are subjected to a high number of mating and demating cycles, such as those used in consumer portable electronic devices. More specifically, electronic devices, such as for example cellular phones, that use a cable and connector to receive power and/or communicate data may require an electrical connector that can survive a high number of mating cycles without failing. To increase the reliability of the connector a hybrid contact assembly can be employed within the receptacle connector, as described in more detail below.

In some embodiments a hybrid receptacle connector includes a housing defining a cavity configured to receive a mating connector. A hybrid contact assembly is positioned within the cavity and includes a contact plate that has multiple fingers, contacts positioned at a distal end of each finger and conductors that run along each finger and electrically couple each contact to an interconnect region positioned outside of the housing. The fingers are made from a first material that is different from a second material that the contacts are made from. In some embodiments, the use of different materials for the fingers and the contacts enables the finger material to be optimized for fatigue resistance, corrosion resistance and strength while the contact material can be independently optimized for low contact resistance, corrosion resistance and wear resistance. Since each material can be independently optimized to perform one function, the hybrid contact assembly can result in improved reliability of the receptacle connector.

In another example the conductors that connect to the contacts and run along the fingers can be formed within a flexible circuit that is laminated to a metallic contact plate to form a contact subassembly. Individual fingers can be formed in the subassembly and contacts made from a material optimized for performance as an electrical contact can be used to form contacts that are attached to a distal end portion of each finger. The contact plate can be formed from a material optimized for strength and fatigue resistance to ensure that the contacts maintain the requisite contact force when mated with a corresponding connector.

In another example a rear cover can be fit within a portion of the receptacle connector housing to seal the mating cavity and secure the hybrid contact assembly within the housing. In other examples a sealant can be applied over the rear cover to seal the receptacle connector such that moisture and/or debris from the external environment cannot pass through the connector and into the electronic device.

In order to better appreciate the features and aspects of electronic receptacle connectors with hybrid contact assemblies, further context for the disclosure is provided in the following section by discussing one particular implementation of an electronic receptacle connector according to embodiments of the present disclosure. These embodiments are for example only and other embodiments can be employed in other electronic connectors. For example, any electronic connector that receives or mates with a corresponding connector can be used with embodiments of the disclosure. In some instances, embodiments of the disclosure are particularly well suited for use with receptacle connectors having internal contacts because of the configuration of the hybrid contact assembly that includes electrical contacts disposed on corresponding resilient deflectable fingers. Such receptacle connectors can include, for example, universal serial bus, RJ-11, RJ-45, printed circuit board edge connectors, proprietary connectors such as the Apple Lightening® connector or any other connector that receives a plug connector and is used to communicate DC power, AC power, digital and/or analog signals.

FIG. 1 illustrates a front isometric view of an electrical receptacle connector 100 according to embodiments of the disclosure. As shown in FIG. 1, receptacle connector 100 can be configured to be positioned within an electronic device (not shown in FIG. 1) and interface with a corresponding plug connector (not shown in FIG. 1) that is received through a receiving opening 105 of housing 110 and into a cavity 115. A plurality of contacts 120 form a portion of a hybrid contact assembly 125 and are positioned within cavity 115 such that they make electrical contact with the corresponding plug connector when it is inserted into the cavity. Hybrid contact assembly 125 is configured to communicate signals between contacts 120 and an interface region 130 that can be coupled to circuitry within the electronic device that houses receptacle connector 100. Hybrid contact assembly 125 can provide improved mechanical and electrical performance as compared to traditional contact assemblies, as described in more detail below.

As further illustrated in FIG. 1 receptacle connector 100 can include one or more mounting bosses 135 that have mounting holes 140 that enable the receptacle connector to be secured within an electronic device. In further embodiments a metal clip 145 can be positioned around a portion of housing 110, around a portion of hybrid contact assembly 125 and can form a ground contact and/or an electromagnetic interference shield, as discussed in more detail below.

Figure 2:
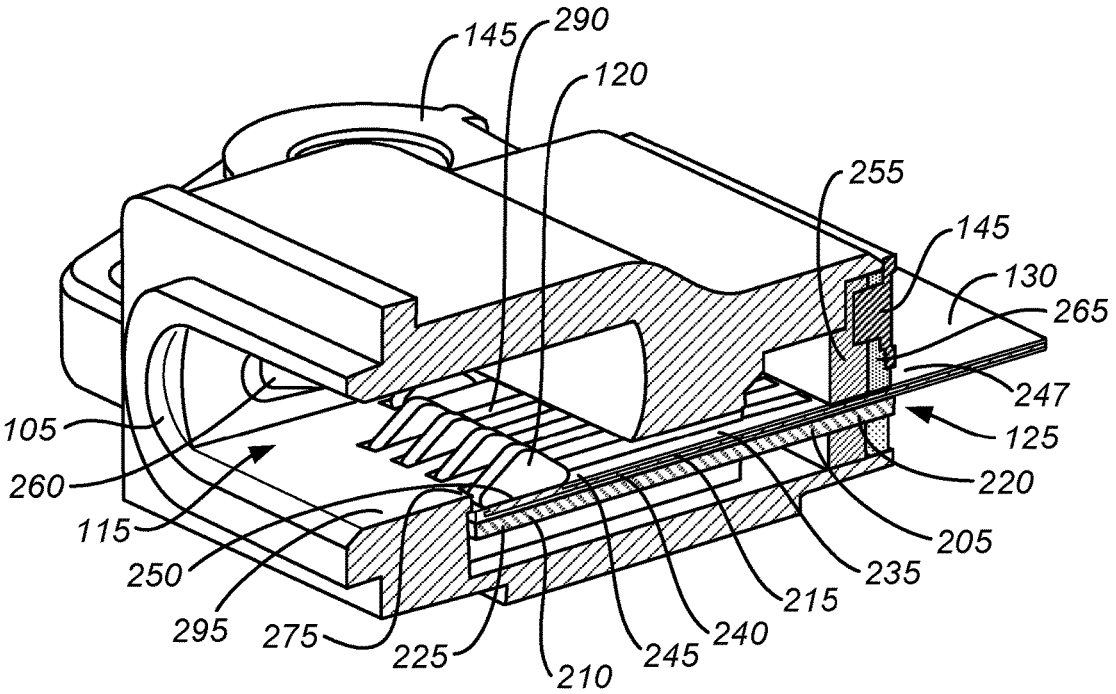
FIG. 2 is a simplified cross-section of the receptacle connector shown in FIG. 1.

FIG. 2 illustrates a simplified cross-sectional view A-A of electronic connector 100 illustrated in FIG. 1. As shown in FIG. 2, cross-section A-A is taken through a portion of housing 110 and shows hybrid contact assembly 125 positioned within cavity 115. Hybrid contact assembly 125 includes a contact plate 205 that includes multiple fingers 210, contacts 120 positioned at a distal end of each finger 210 and conductors 215 that run along each finger and electrically couple each contact to interconnect region 130. Fingers 210 are made from a first material that is different from a second material that contacts 120 are made from. In some embodiments, the use of different materials for fingers 210 and contacts 120 enables the finger material to be optimized for fatigue resistance, corrosion resistance and strength while the contact material can be independently optimized for low contact resistance, corrosion resistance and wear resistance. In one example, fingers 210 can be made from a steel material that has a higher modulus of elasticity than a gold-based material used for contacts 120. In this particular embodiment, hybrid contact assembly 125 will have resilient fingers 210 and ductile contacts 120.

In contrast, traditional contact assemblies typically use a single material for the resilient fingers and the contacts, or they form the fingers from one material and plate them with a separate material that functions as the contact material. The inventors have recognized, however, that materials that are typically well suited for fingers (e.g., stainless steel, titanium, tantalum, beryllium-copper, phosphor-bronze, copper, etc.) may not be well suited for use as contacts, and materials that are well suited for contacts (e.g., (gold, silver, palladium, noble metal alloys, etc.) may not be well suited for use as fingers. Further, if the contact material is plated on the fingers, the plating is typically relatively thin and prone to wear, pin holes and/or cracking that result in corrosion and degradation of performance of the connector. Therefore, the described embodiments of a hybrid contact assembly can result in improved connector performance and reliability since they enable the use of a first material that is selected to function only as a resilient finger and a second material that is selected to function only as an electrical contact, as discussed in more detail below.

As further shown in FIG. 2, in some embodiments contact plate 205 includes a unified base portion 220 and individual fingers 210 extend therefrom to distal end portions 225 that are positioned within cavity 115. More specifically, in such embodiments contact plate 205 can be made from a single plate of material having a plurality of fingers 210 that are coupled to unified base portion 220 that holds all the fingers together. This is illustrated more clearly in FIG. 8.

In other embodiments contact plate 205 may not have a unified base portion 220 and therefore each finger 210 can be separate with each finger having its own separate base portion that is secured to housing 110. In some embodiments contact plate 205 can be made from a material exhibiting high fatigue resistance, and/or a high modulus of elasticity such as, for example, stainless steel, titanium, tantalum, beryllium-copper, phosphor-bronze, copper, silicon or any other appropriate material. Contact plate 205 can be formed by stamping, etching, injection molding, water jet cutting or any other suitable process. In some embodiments fingers 210 can be formed to be uniform in shape as shown in FIG. 2, however in other embodiments the fingers can be non-uniform in shape (e.g., formed, coined, etc.) enabling different mechanical properties for the fingers and receptacle connector 100.

The geometry of fingers 210 is not limited to the specific geometry depicted in FIG. 2. A person of skill in the art will appreciate that, in other embodiments, fingers 210 can have a size, shape and overall geometry different than the specific examples set forth herein. In some embodiments a width of each finger 210 is between 100 microns and 1000 microns while in some embodiments the width is between 200 microns and 500 microns and in some embodiments the width is between 350 microns and 400 microns. In some embodiments a gap between each finger 210 is between 50 microns and 800 microns while in some embodiments the gap is between 100 microns and 400 microns and in some embodiments the gap is between 225 microns and 275 microns. In some embodiments a thickness of each finger 210 is between 50 microns and 800 microns while in some embodiments the gap is between 100 microns and 400 microns and in some embodiments the gap is between 175 microns and 225 microns. In some embodiments a length of each finger can be between 5 and 100 times the width of the finger while in some embodiments the length of each finger can be between 10 and 50 times the width and in some embodiments the length of each finger can be between 15 and 30 times the width.

As introduced above, an electrical conductor 215 is attached to each finger 210 and extends from distal end portion 225 of each finger 210 to interface region 130 that is outside of housing 110. In some embodiments each conductor 215 forms a portion of a flexible circuit 235 that is attached to contact plate 205. Flexible circuit 235 can include a plurality of conductors 215 separated from contact plate 205 by a first dielectric layer 240. A second dielectric layer 245 can be positioned on top of each of the plurality of conductors 215, as described in greater detail below.

In the embodiment illustrated in FIG. 2, flexible circuit 235 can have a common flexible circuit base portion 247 and individual fingers of the flexible circuit can extend therefrom. In other embodiments each conductor 215 is separate from the other conductors (e.g., there is no common flexible circuit base portion for all of the fingers) and is electrically isolated from contact plate 205 by a dielectric layer formed on each corresponding finger. In some embodiments each conductor 215 can be formed on a dielectric layer that is positioned on each finger through, for example, electro-less and/or electrolytic plating, lamination or thin film deposition. In yet further embodiments contact plate 205 and fingers 210 can be made from an electrically insulative material and each conductor 215 is attached directly to each finger, without the need for an intervening dielectric layer.

As further illustrated in FIG. 2, each contact 120 is attached to distal end portion 225 of each corresponding finger 210 with a conductive joint 250. In some embodiments contact 120 is made from a material that is conducive to forming a low contact resistance connection to a corresponding mating connector, is corrosion resistant and/or wear resistant. In some embodiments contact 120 can be formed from, for example, gold, silver, palladium, a noble metal alloy such as Neyoro G®, Paliney 7®, or any other conductive material. In various embodiments each contact 120 is formed from a monolithic material as compared to traditional contacts that can be formed from a metal that is plated on a different base material. As compared to traditional plated contacts, since in some embodiments contacts 120 are made from a monolithic material, they are not prone to cyclical wear that exposes the underlying base material, typically resulting in corrosion of the underlying base material and connector failure. Contact 120 can be of any shape and in one embodiment has a flat lower surface where conductive joint 250 is formed and has a rounded contact region that is opposite the flat lower surface and forms an electrical contact with the mating connector.

In some embodiments conductive joint 250 is formed by solder, which is used to mechanically and electrically couple each contact 120 to a corresponding conductor 215. Other embodiments can form conductive joint 250 with an electrically conductive adhesive, welding, or other process as described in more detail below. In various embodiments a passivation material (not shown in FIG. 2) can be applied around conductive joint 250. In one embodiment an underfill or potting material can be used as the passivation material to passivate conductive joint 250 and/or add strength.

Figure 16:
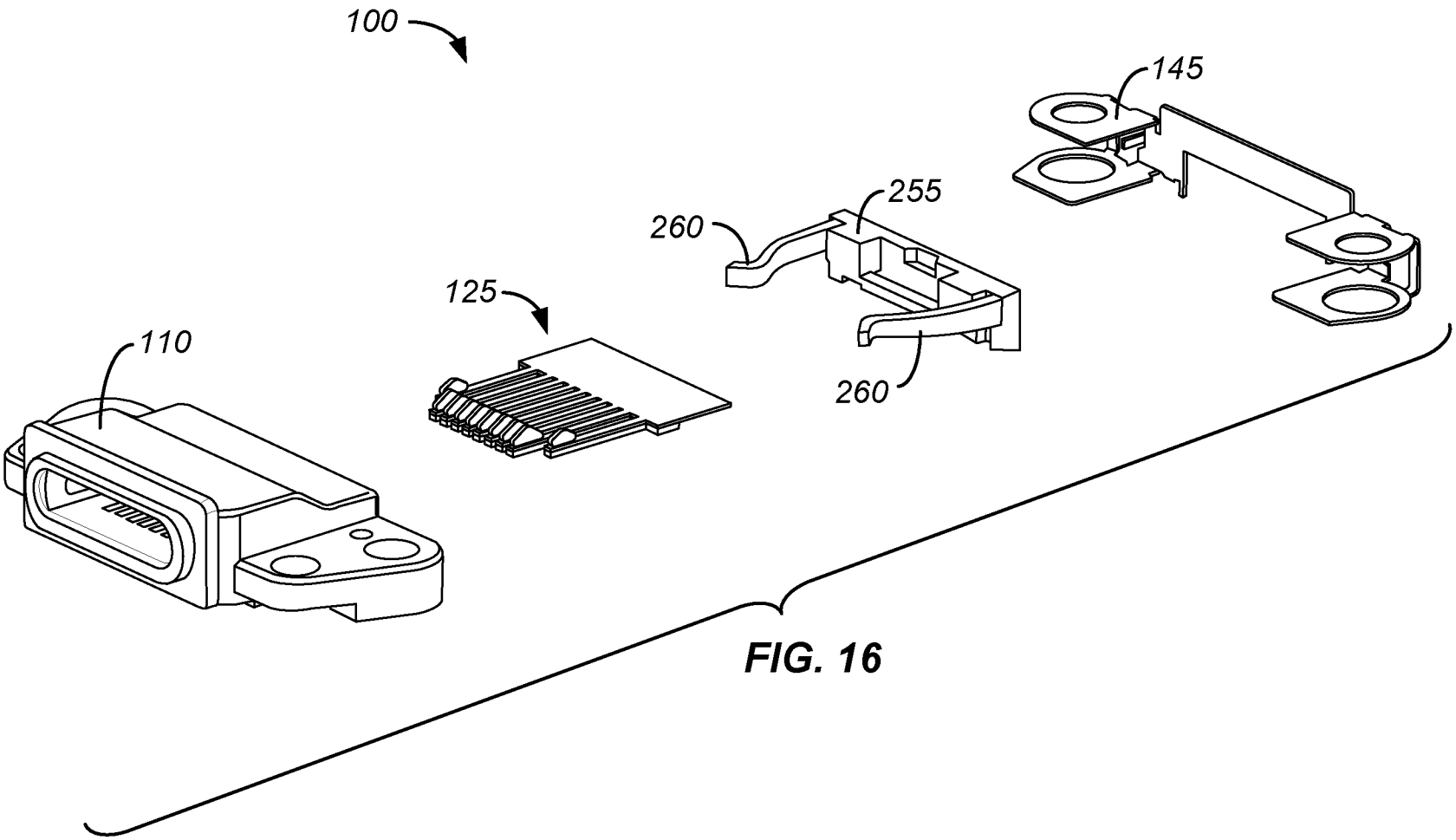
FIG. 16 illustrates an exploded view of the components of the receptacle connector illustrated in FIG. 1.

As further illustrated in FIG. 2, a rear cover 255 can be fit within housing 110, around hybrid contact assembly 125 and can include a pair of ground contacts 260, as shown in FIG. 16 below. In further embodiments a sealing layer 265 can be applied over rear cover 255 to seal connector 100 and make it resilient and/or impermeable to liquid and/or debris. More specifically, sealing layer 265 can be used to form a seal between housing 110, hybrid contact assembly 125 and rear cover 255 such that liquid or debris that enters cavity 115 cannot penetrate receptacle connector 100 and make its way into the electronic device in which the receptacle connector is mounted. In some embodiments sealing layer 265 can include an adhesive, an insert molded material or a sealant.

Metal clip 145 can be attached to a portion of housing 110 and can function as a ground connection for receptacle connector 100 and can be coupled to pair of ground contacts 260 to provide a path to ground for the corresponding mating connector. Metal clip 145 can be made from any conductive metal including, but not limited to, stainless steel and plated copper alloys.

Housing 110 can be a monolithic insulative structure that can be made by injection molding or other suitable process. In some embodiments housing 110 can include a lip 275 that functions as a stop, preventing fingers 210 from moving into cavity 115. In various embodiments fingers 210 can be formed so they are all "pre-stressed" against lip 275 so the lip holds them all in a controlled position and at a precise location within cavity 115. More specifically, fingers 210 can be formed such that without lip 275 the fingers would be positioned in cavity 115, but lip 275 holds the fingers out of the cavity. Therefore lip 275 can function as a stop for all fingers 210 so the fingers are all uniformly positioned against the lip. Housing 110 can also include one or more slots 290 that are disposed in bottom wall 295 and are configured to receive fingers 210 and maintain the fingers in position within cavity 115 and electrically isolated from one another. In some embodiments housing 110 can be made from an electrically insulative polymer such as, for example, a polycarbonate.

Figure 3:
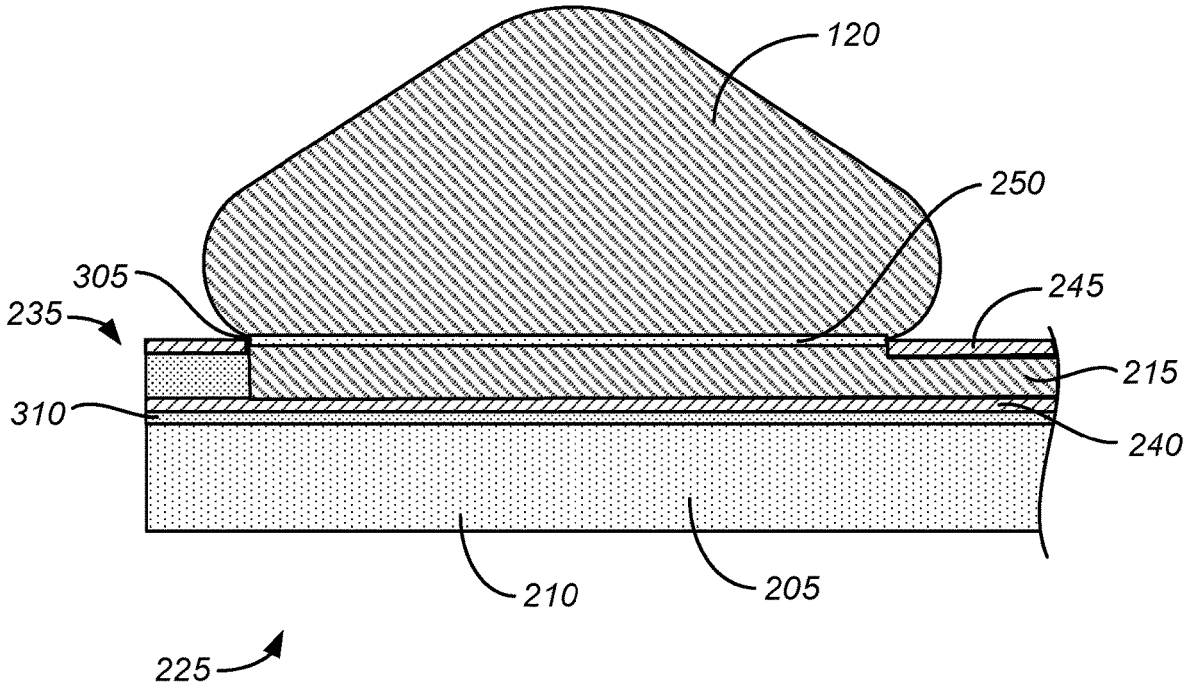
FIG. 3 is a close-up view of a portion of the simplified cross-sectional view of the receptacle connector shown in FIG. 2.

FIG. 3 is a close-up side view of distal end portion 225 of finger 210 that is illustrated in FIG. 2. As shown in FIG. 3, in some embodiments flexible circuit 235 includes one or more conductors 215. Flexible circuit 235 can include first dielectric layer 240 that is positioned between conductor 215 and finger 210 of contact plate 205 to electrically isolate the conductor from the finger of the contact plate. Conductor 215 can be positioned on top of first dielectric layer 240 and can be made from copper or any other electrically conductive material. In some embodiments conductor 215 has a thickness between 10 microns and 1000 microns while in another embodiment it has a thickness between 20 microns and 500 microns and in one embodiment has thickness between 30 and 40 microns.

Second dielectric layer 245 can be formed on top of conductor 215 and portions of first dielectric layer 240 such that the conductor is encapsulated between first and second dielectric layers, 240, 245, respectively. In some embodiments first and second dielectric layers 240, 245, respectively, can be made from a polymer or other dielectric material that can include for example, polyamide, epoxy, polymer or teflon. In further embodiments second dielectric layer 245 can have an opening 305 that exposes conductor 215. Contact 120 can be electrically coupled to conductor 215 within opening 305 with conductive joint 250. Conductive joint 250 can be formed with solder, conductive adhesive, welding, or any other method. In some embodiments flexible circuit 235 can be attached to contact plate 205 with an adhesive layer 310 that can be, for example, a pressure sensitive or heat sensitive adhesive.

Flexible circuit 235, as disclosed herein, describes a circuit that includes an insulating dielectric film having conductive circuit patterns affixed thereto and can also include a polymer coating formed over the conductive circuits. Flexible circuits can include a single metal layer, two or more metal layers and/or a combination of flexible and rigid circuits. In some embodiments flexible circuit 235 is formed by etching metal foil cladding (normally of copper) from polymer bases, plating metal or printing of conductive inks, among other processes. Flexible circuits can also include one or more electronic passive or active components attached thereto. In various embodiments, flexible circuit 235 can be fabricated using a lamination process that adheres metal and dielectric layers together with an adhesive or polymer under pressure, elevated temperature and/or vacuum.

In some embodiments flexible circuit 235 can be designed with parameters that are optimized for high speed data transmission. More specifically, first and second dielectric layers 240, 245, respectively can be selected to have a particular dielectric constant, loss tangent and/or other electrical property and can be made from any material including but not limited to a polymer, an epoxy, a teflon or a ceramic. Conductor 215 can be designed to have a particular width, thickness and/or separation from a ground such that it has a designed impedance that enables conductor 215 to efficiently transmit high speed signals. In some embodiments the high speed signals can be above 5 MHz, while in another embodiment the high speed signals can be above 5 GHz and in some embodiments the high speed signals can be above 20 GHz. In some embodiments conductor 215 can be designed as a microstrip conductor that has a particular impedance to a separate ground layer disposed within flexible circuit 235 or the ground layer can be fingers 210. In another embodiment conductor 215 can be designed as a stripline conductor having a ground plane both above and below the conductor. In yet further embodiments conductor 215 can be designed as a coplanar waveguide conductor having a ground on either side of the conductor. In another embodiment conductor 215 can have grounds above, below and to each side.

In further embodiments each conductor 215 can be separate (not a portion of a unitary flexible circuit as described above) and can be electrically isolated from contact plate 205 by a dielectric layer formed on each corresponding finger 210. In some embodiments each conductor 215 can be formed on a the dielectric layer on each corresponding finger using, for example, electroless and/or electrolytic plating, lamination, photoimaging or thin film deposition. In yet further embodiments contact plate 205 and fingers 210 can be formed from an electrically insulative material (e.g., made from silicon or plastic) and conductor 215 can be attached directly to each respective finger 210 without the need for an intervening dielectric layer.

Figure 4:
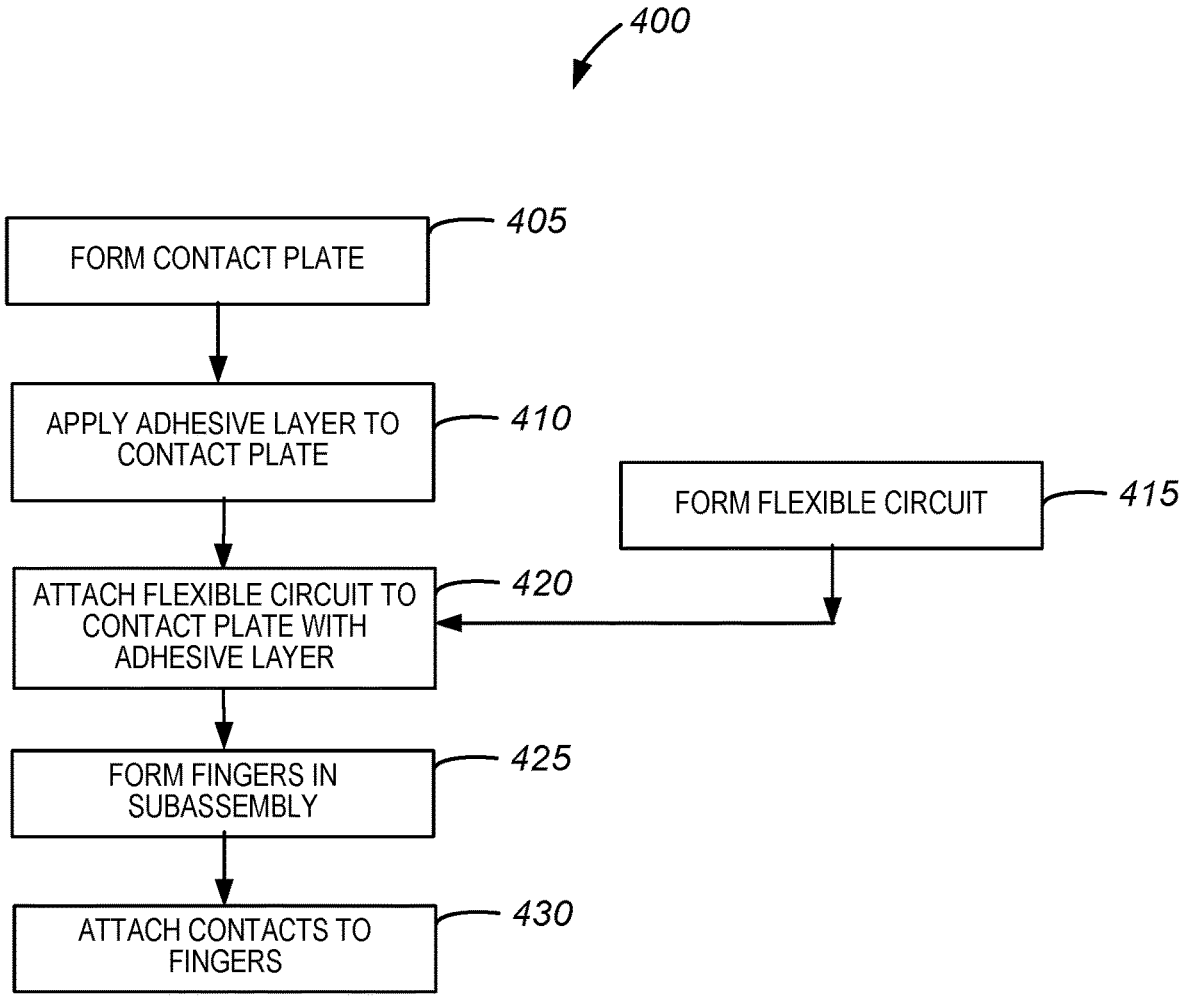
FIG. 4 is a method for making a hybrid contact assembly that can be used in the receptacle connector illustrated in FIG. 1.

FIG. 4 illustrates steps associated with a method 400 of forming a hybrid contact assembly that can be used in a receptacle connector such as receptacle connector 100 illustrated in FIG. 1, according embodiments of the disclosure. FIGS. 5-9 illustrate simplified sequential views of the steps associated with forming the hybrid contact assembly according to method 400 described in FIG. 4.

Figure 5:
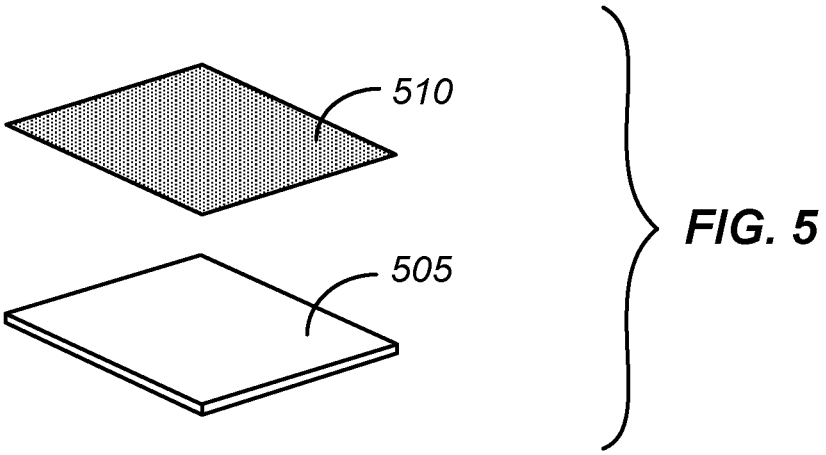
FIGS. 5-9 illustrate sequential steps associated with the method of making the hybrid contact assembly described in FIG. 4.

As illustrated in FIG. 4, in step 405 a contact plate is formed using any appropriate manufacturing technique. Referring to FIG. 5, in some embodiments a contact plate 505 is formed from a sheet of stainless steel, titanium, tantalum, beryllium-copper, phosphor-bronze, copper, silicon or another suitable conductive material using stamping, casting, cutting, sawing or any other process. In some embodiments contact plate 505 can be rectangular as shown, however in other embodiments it can have a different geometry.

In step 410, an adhesive layer is applied to the contact plate. Referring to FIG. 5 adhesive layer 510 is aligned with contact plate 505 and is attached to the contact plate. In some embodiments adhesive layer 510 can be a pressure sensitive or a temperature sensitive adhesive.

Figure 6:
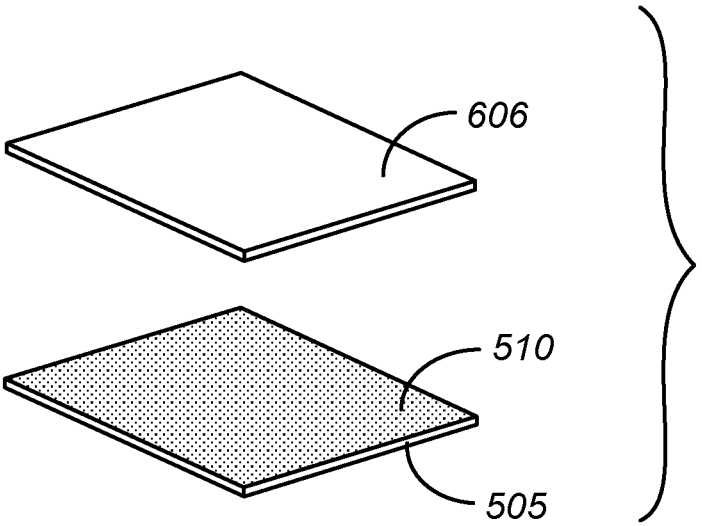
Figure 7:
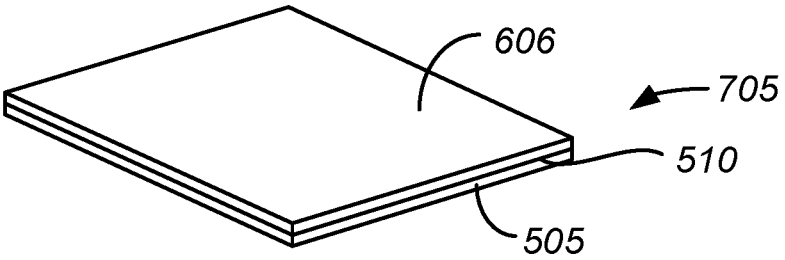

In step 415 a flexible circuit is formed. Referring to FIG. 6, flexible circuit 606 includes a plurality of conductors (not shown in FIG. 6) that will be discussed in greater detail below. Flexible circuit 606 can be made from a metal layer sandwiched between two polymer layers as described above.

In step 420 the flexible circuit is attached to the adhesive layer on the contact plate. Referring to FIG. 6 flexible circuit 606 is aligned with contact plate 505 and as further shown in FIG. 7 the flexible circuit is attached to the contact plate forming a subassembly 705.

Figure 8:
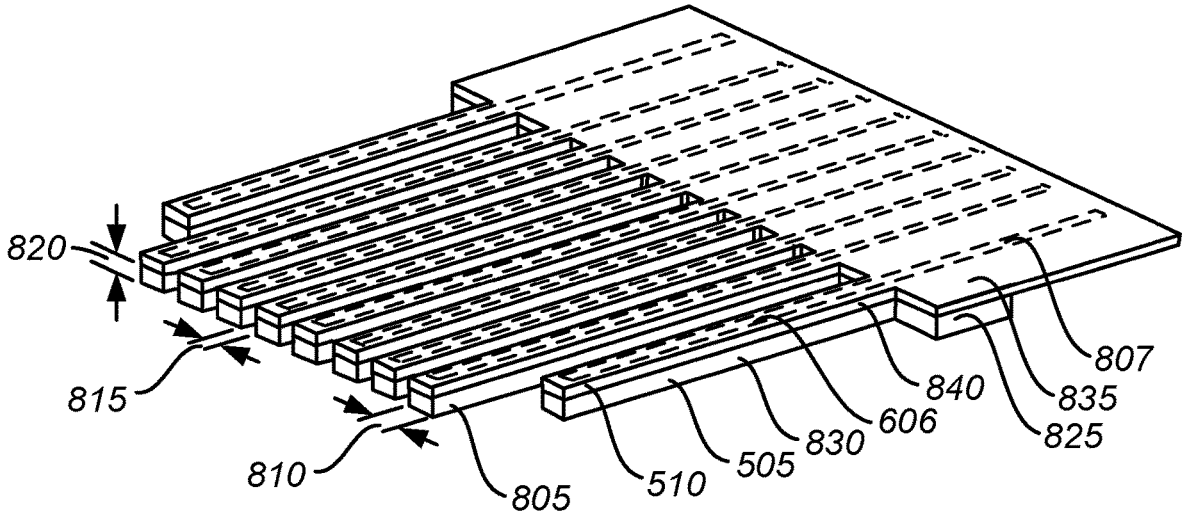

In step 425 fingers are formed in the subassembly. Referring to FIG. 8, fingers 805 are formed in subassembly 705 creating multiple fingers with each having a portion of flexible circuit 606 attached thereto. More specifically, each finger 805 includes a layer of contact plate 505 with a layer of flexible circuit 606 attached thereto. As discussed above, flexible circuit 606 includes conductors 807 that run along each finger 805. The geometry of fingers 805 of contact plate 505 can be any appropriate dimension and this disclosure in no way limits their geometry. In some embodiments fingers 805 are formed by placing subassembly 705 (see FIG. 7) in a stamping machine and cutting away portions of contact plate 505 and flexible circuit 606 between the fingers. In other embodiments a cutting process, such as for example, a laser or a water jet can be used to cut away the material between the fingers.

When the material between the fingers is removed as shown in FIG. 8A, contact plate 505 then has a unified base portion 825 and a plurality of contact plate fingers 830 that extend therefrom. Similarly, after the material between the fingers is removed as shown in FIG. 8A, flexible circuit 606 has a common flexible circuit base portion 835 and a plurality of flexible circuit fingers 840 that extend therefrom.

In some embodiments a width 810 of each finger 805 is between 100 microns and 1000 microns while in some embodiments the width is between 200 microns and 500 microns and in some embodiments the width is between 350 microns and 400 microns. In some embodiments a gap 815 between each finger 805 is between 50 microns and 800 microns while in some embodiments the gap is between 100 microns and 400 microns and in some embodiments the gap is between 225 microns and 275 microns. In some embodiments a thickness 820 of each finger 805 is between 50 microns and 800 microns while in some embodiments the gap is between 100 microns and 400 microns and in some embodiments the gap is between 175 microns and 225 microns.

Figure 9:
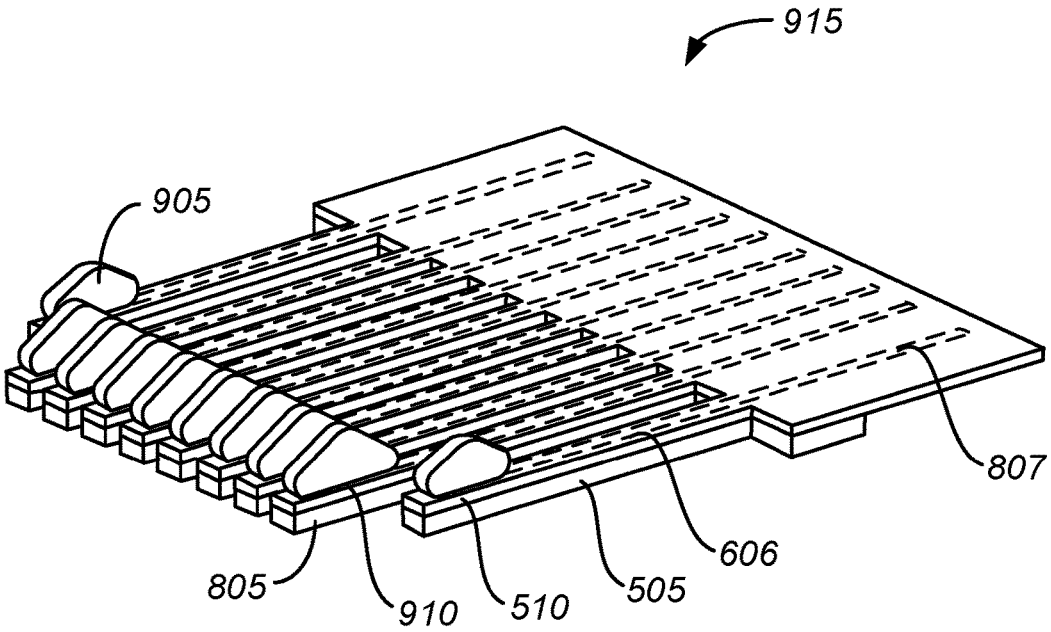

In step 430, contacts are attached to each finger. Referring to FIG. 9, contacts 905 are attached to conductors 807 at distal end portions of each finger 805 with a conductive joint 910. Conductive joint 910 can be formed with surface mount soldering (SMT), hot bar soldering, electrically conductive adhesive, welding or any other process. In some embodiments a passivation coating (not shown in FIG. 9) can be applied to each conductive joint 910. Hybrid contact assembly 915 is now complete and ready for assembly into a connector housing, as described in more detail below.

Figure 10:
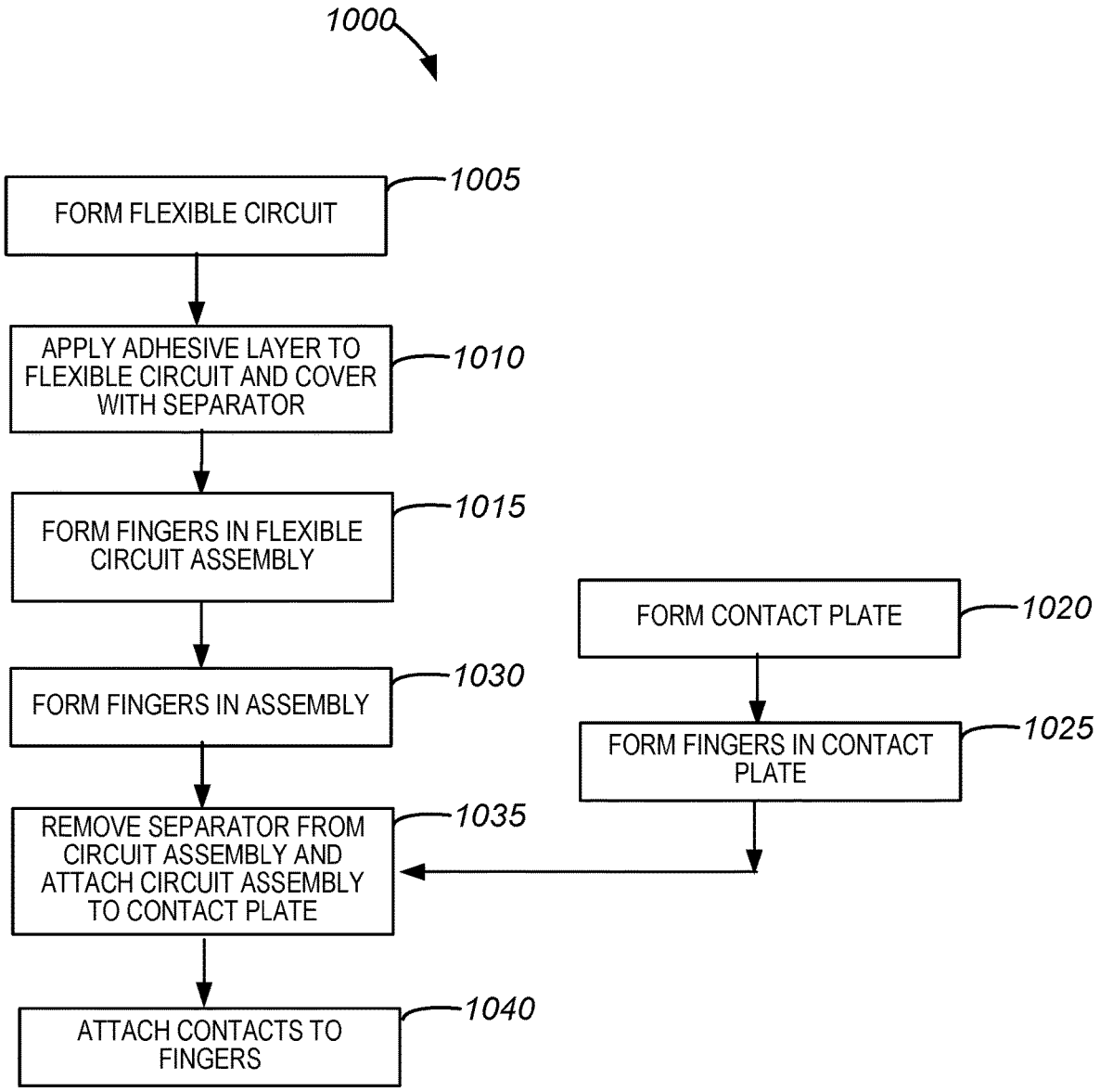
FIG. 10 is another method for making a hybrid contact assembly that can be used in the receptacle connector illustrated in FIG. 1.

FIG. 10 illustrates steps associated with another method 1000 of forming a hybrid contact assembly according embodiments of the disclosure. Method 1000 of FIG. 10 is similar to method 400 of FIG. 4, however instead of attaching the flexible circuit to the contact plate then forming the fingers through the subassembly, in the method of FIG. 10 fingers are first formed in the flexible circuit and separately in the contact plate, then the components are attached together. FIGS. 11-15 illustrate simplified sequential views of the steps associated with forming the hybrid contact assembly according to method 1000 described in FIG. 10.

Figure 11:
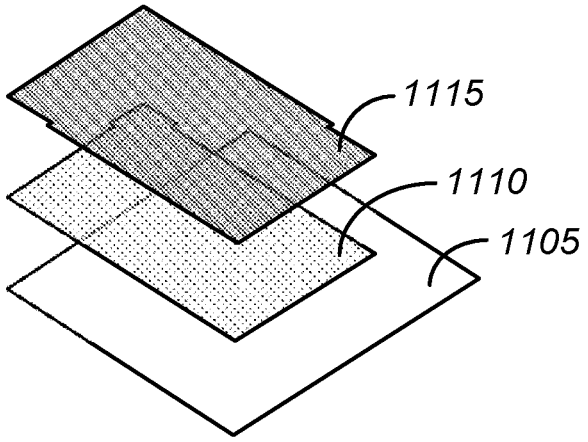
FIGS. 11-15 illustrate sequential steps associated with the method of making the hybrid contact assembly described in FIG. 10.

In step 1005 a flexible circuit is formed. Referring to FIG. 11 flexible circuit 1105 includes a plurality of conductors (not shown in FIG. 11) that were discussed in greater detail above. Flexible circuit 1105 can be made from a metal layer sandwiched between two polymer layers.

Figure 12:
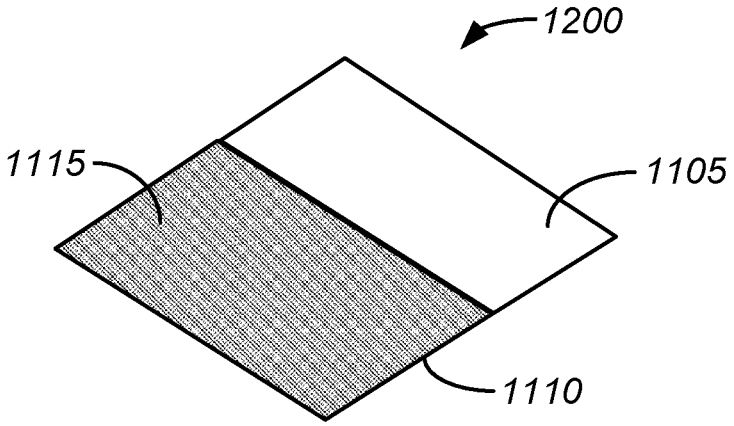

In step 1010, an adhesive layer is applied to the contact plate and covered with a separator that can be easily detached from the adhesive layer. Referring to FIG. 11 adhesive layer 1110 is aligned with flexible circuit 1105 and is attached to the flexible circuit. As further illustrated in FIG. 11 a separator 1115 is placed over adhesive layer 1110 to protect the adhesive from damage during subsequent processing steps. The final subassembly 1200 is shown in FIG. 12, illustrating flexible circuit 1105, adhesive layer 1110 and separator 1115 laminated together.

Figure 13:
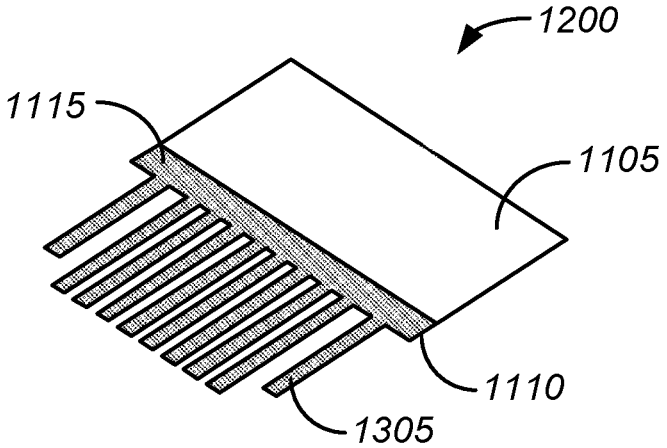

In step 1015 fingers are formed in the subassembly. Referring to FIG. 13, fingers 1305 are formed in subassembly 1200 creating multiple fingers with each finger including a portion of flexible circuit 1105, adhesive 1110 and separator 1115. More specifically, each finger 1305 includes a layer of flexible circuit 1105, a layer of adhesive 1110 and a layer of separator 1115. As discussed above, flexible circuit 1105 includes conductors (not shown in FIG. 13) that run along each finger 1305. Fingers 1305 can be formed by punching, cutting or any other process.

Figure 14:
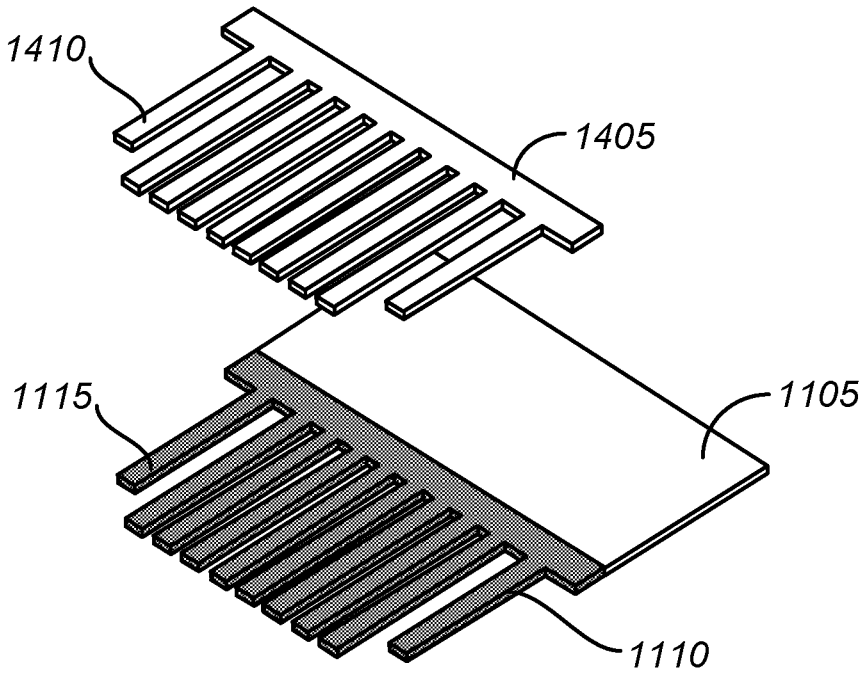

In step 1020 a contact plate is formed using any appropriate manufacturing technique. Referring to FIG. 14, a contact plate 1405 is formed from a sheet of stainless steel, titanium, tantalum, beryllium-copper, phosphor-bronze, copper, silicon or any other material using stamping, casting, cutting, injection molding, sawing or any other process. In some embodiments contact plate 1405 can be rectangular as shown, however in other embodiments it can have a different geometry.

In step 1025 fingers are formed in the contact plate. Still referring to FIG. 14, fingers 1410 are formed in contact plate 1405 using any appropriate manufacturing technique. More specifically, fingers 1305 can be formed using stamping, casting, cutting, sawing or any other process.

Figure 15:
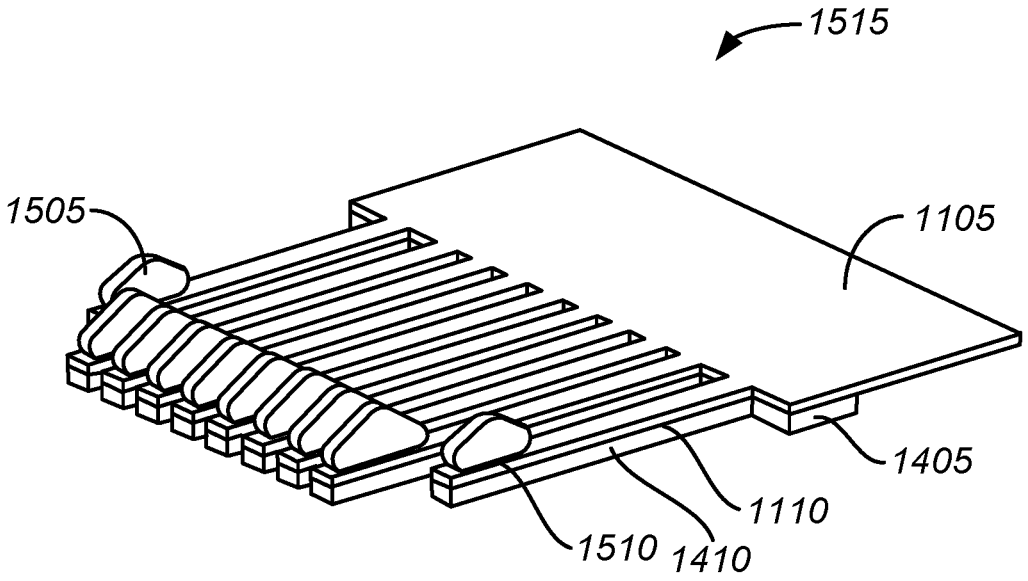

In step 1035 the flexible circuit is attached to the contact plate. Referring to FIG. 15, the assembly illustrated in FIG. 14 is flipped upside down and separator 1115 is removed from flexible circuit 1105 exposing adhesive layer 1110. Flexible circuit 1105 is aligned with contact plate 1405 and the two are bonded together.

In step 1040, a contact is attached to each finger. Still referring to FIG. 15, contacts 1505 are attached to distal end portions of each finger 1410 with a conductive joint 1510. Conductive joint 1510 is formed between contacts 1505 and conductors within flexible circuit 1105. Conductive joint 1510 can be formed with surface mount soldering (SMT), hot bar soldering, electrically conductive adhesive, welding or any other process. In some embodiments a passivation coating (not shown in FIG. 15) can be applied to each conductive joint 1510. Hybrid contact assembly 1515 is now complete and ready for assembly into a housing.

FIG. 16 illustrates an exploded view of the components of one embodiment of connector 100. As shown in FIG. 16, housing 110 is configured to receive hybrid contact assembly 125 through a rear opening formed within the housing. After hybrid contact assembly 125 is placed within housing 110, rear cover 255 is configured to be positioned within the housing and at least partially around hybrid contact assembly 125. In some embodiments rear cover 255 can include ground contacts 260 that can be insert-molded or stitched within the rear cover. In some embodiments a sealant can be applied over rear cover to seal housing, hybrid contact assembly and rear cover so moisture and/or debris cannot pass through connector 100. In some embodiments metal clip 145 is positioned at least partially around housing 110 and can make contact with ground contacts 260.

The figures above illustrate an example receptacle connector to demonstrate one way of using a hybrid contact assembly and in no way limit this disclosure to other receptacle connector designs and/or configurations. In some embodiments the features described herein can be employed in a universal serial bus receptacle connector, an RJ-45 or RJ-11 receptacle connector, a printed circuit board edge connector, proprietary connectors or any other type of connector.

In further embodiments a receptacle connector, such as for example receptacle connector 100 illustrated in FIG. 1 can be configured to mate with an axisymmetric plug connector such that the cavity and the receiving opening are shaped to receive the corresponding plug connector in both a first orientation and in a second orientation that is rotated 180 degrees from the first orientation. More specifically, the corresponding plug connector can be symmetric such that it can be plugged into the receptacle connector in two orientations that are 180 degrees apart. In either orientation only the contacts that make contact with the electrical contacts within the receptacle connector will be used.

In the foregoing specification, embodiments of the disclosure have been described with reference to numerous specific details that can vary from implementation to implementation. The specification and drawings are, accordingly, to be regarded in an illustrative rather than a restrictive sense. The sole and exclusive indicator of the scope of the disclosure, and what is intended by the applicants to be the scope of the disclosure, is the literal and equivalent scope of the set of claims that issue from this application, in the specific form in which such claims issue, including any subsequent correction. The specific details of particular embodiments can be combined in any suitable manner without departing from the spirit and scope of embodiments of the disclosure.

Additionally, spatially relative terms, such as "bottom or "top" and the like can be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as a "bottom" surface can then be oriented "above" other elements or features. The device can be otherwise oriented (e.g., rotated 90 degrees or at other orientations) and the spatially relative descriptors used herein interpreted accordingly.

What is claimed is:

1. A receptacle connector comprising:

a housing defining a cavity and including a receiving opening for the cavity, the cavity and the receiving opening shaped to allow a corresponding plug connector to be inserted through the receiving opening and into the cavity;

a plurality of fingers, each finger having a base portion secured to the housing and a distal end portion positioned within the cavity;

a plurality of electrical conductors, each electrical conductor attached to a respective one of the plurality of fingers and extending from the distal end portion of a respective one of the plurality of fingers to an interconnect region positioned outside of the housing; and a plurality of electrical contacts, each electrical contact separate from and attached to a respective one of the plurality of electrical conductors and positioned proximate the distal end portion of a respective one of the plurality of fingers.

2. The receptacle connector of claim 1 wherein each of the plurality of fingers comprises a first metal having a first modulus of elasticity and each of the plurality of electrical contacts comprises a second metal having a second modulus of elasticity, wherein the first modulus of elasticity is higher than the second modulus of elasticity.

3. The receptacle connector of claim 1 wherein the plurality of electrical conductors are integrated within a flexible circuit.

4. The receptacle connector of claim 3 wherein the interconnect region is formed from a portion of the flexible circuit.

5. The receptacle connector of claim 1 wherein the base portions of each of the plurality of fingers are coupled together forming a common base portion.

6. The receptacle connector of claim 1 wherein the plurality of electrical contacts are electrically insulated from the plurality of fingers.

7. The receptacle connector of claim 1 wherein the cavity and the receiving opening are shaped to allow the corresponding plug connector to be inserted through the receiving opening and into the cavity in a first orientation and in a second orientation, wherein the second orientation is rotated 180 degrees from the first orientation.

8. A receptacle connector comprising:

a housing defining a cavity and including a receiving opening for the cavity, the cavity and the receiving opening shaped to allow a corresponding plug connector to be inserted through the receiving opening and into the cavity;

a finger having a base portion secured to the housing and a distal end portion positioned within the cavity;

an electrical conductor attached to the finger and extending from the distal end portion to an interconnect region positioned outside of the housing; and an electrical contact separate from and attached to the electrical conductor, and positioned proximate the distal end portion of the finger.

9. The receptacle connector of claim 8 further comprising a plurality of fingers, each finger having a base portion.

10. The receptacle connector of claim 9 wherein the base portion of each of the plurality of fingers is coupled together forming a common base portion.

11. The receptacle connector of claim 8 further comprising a plurality of electrical conductors.

12. The receptacle connector of claim 11 wherein the plurality of electrical conductors are integrated within a flexible circuit.

13. The receptacle connector of claim 8 further comprising an insulator positioned between the electrical conductor and the finger.

14. The receptacle connector of claim 8 wherein the finger comprises a first metal and the electrical contact comprises a second metal, and wherein the first metal has a higher modulus of elasticity than the second metal.

15. The receptacle connector of claim 8 wherein the electrical contact is electrically insulated from the finger.

16. The receptacle connector of claim 8 wherein the cavity and the receiving opening are shaped to allow the corresponding plug connector to be inserted through the receiving opening and into the cavity in a first orientation and in a second orientation, wherein the second orientation is rotated 180 degrees from the first orientation.

17. The receptacle connector of claim 8 further comprising a rear cover that is received within a rear opening of the housing.

18. The receptacle connector of claim 17 wherein the rear cover includes at least one ground prong that extends into the cavity.

19. The receptacle connector of claim 8 wherein the finger comprises stainless steel.

20. The receptacle connector of claim 8 wherein the electrical contact comprises gold.

* * * * *